US008335748B2

(12) United States Patent
Salomon et al.

(10) Patent No.: US 8,335,748 B2
(45) Date of Patent: Dec. 18, 2012

(54) SYSTEM AND METHOD FOR DIMENSIONAL RATING OF A MAILPIECE

(75) Inventors: James A. Salomon, Cheshire, CT (US); Christopher M. Giles, Monroe, CT (US)

(73) Assignee: Pitney Bowes Inc., Stamford, CT (US)

( * ) Notice: Subject to any disclaimer, the term of this patent is extended or adjusted under 35 U.S.C. 154(b) by 236 days.

(21) Appl. No.: 12/791,518

(22) Filed: Jun. 1, 2010

(65) Prior Publication Data

US 2011/0295769 A1 Dec. 1, 2011

(51) Int. Cl.
*G07B 17/02* (2006.01)

(52) U.S. Cl. ..... 705/406

(58) Field of Classification Search ..... 705/406
See application file for complete search history.

(56) References Cited

U.S. PATENT DOCUMENTS 4,605,937 A * 8/1986 Dolan et al. ..... 347/188
5,699,258 A * 12/1997 Thiel ..... 705/409
6,138,371 A * 10/2000 Lippa et al. ..... 33/562
2004/0212833 A1* 10/2004 Taskett et al. ..... 358/1.18
2005/0068356 A1* 3/2005 Nambudiri ..... 347/14
2008/0216337 A1* 9/2008 Chen ..... 33/759

OTHER PUBLICATIONS

Lipinski, Edward R., "Before Hanging the Wallpaper, Preparations Are in Order," New York Times, Late Edition, East Coast, New York, NY, Dec. 15, 1996, p. 13WC.14.*
Federal Information and News Dispatch Inc., "New Standards for Domestic Mailing Services," Lanham, United States, 2007.*

* cited by examiner

*Primary Examiner* — Nathan Erb
(74) *Attorney, Agent, or Firm* — Brian A. Collins; Charles R. Malandra, Jr.; Steven J. Shapiro

(57) ABSTRACT

A mailing machine for the creation of mailpieces includes a print station and a transport system for passing a length of the label material through the print station to receive information on a face surface of the label material. A processor is adapted to store rating information based upon the weight and dimensions of the mailpiece and is operatively coupled to, and controls, the print station and transport system. In a first operating mode, the processor prints rating information on a length of label material, and in a second operating mode, the processor prints postage indicia on the face surface of the label material based upon the rating information for subsequent application to a mailpiece. In the second operating mode, the postage indicia may optionally be printed on the label material or directly on the face surface of the mailpiece envelope.

14 Claims, 2 Drawing Sheets

SYSTEM AND METHOD FOR DIMENSIONAL RATING OF A MAILPIECE

TECHNICAL FIELD

This invention relates to a system for dimensional rating of a mailpiece/parcel, and, more particularly, to a system and method for measuring the length/volume of an article to determine the postage requirements for delivery thereof.

BACKGROUND ART

The Postal Accountability and Enhancement Act of December 2006, otherwise known as Postal Reform (PR), has resulted in numerous changes in the way that delivery service is provided for mailpieces/parcels across the United States. In addition to the privatization of certain functions, Postal Reform has resulted in various changes in the way that mail/parcels are delivered including the delivery schedule, the number of days that service is provided, where a mailpiece/parcel will/will not be delivered, e.g., delivery may only be provided to a local post office box rather than to a specific address in rural locations, and the cost charged for delivery services.

With respect to the latter, PR has resulted in one rather significant adjustment in the way the postage rates are applied. Whereas, in the past, the cost of delivery services was based strictly on weight, more recently, PR has introduced a rate structure based upon both the weight and size of a mailpiece/parcel. In accordance with the new rate structure, the cost of mailing a conventional type-ten (10) envelope may be based upon weight, whereas, the cost of mailing a parcel may be based upon both weight and volume or size. Even more recently, the postal service has introduced a system wherein the delivery cost is based strictly on the volume of a particular delivery item. According to a popular television advertisement, "If the item fits", i.e., within one of four size boxes, the "then, we'll ship" for a standard rate regardless of weight. As a result, a customer is encouraged to know, or estimate the size of, an article for shipping to minimize cost.

In view of the lack of readily available volumetric estimates concerning the size of an article, a customer must become intimately familiar with the "break-points" associated with the length, width and/or height/depth of an article to accurately evaluate the delivery cost of an item. Generally, this is performed by: (i) acquiring a familiarity of the dimensions associated with each of the standardized containers and (ii) measuring, i.e., with a conventional ruler, the dimensions of an item to be shipped, to obtain an estimate of the shipping costs. Furthermore, due to the frequency of regulatory changes, a customer cannot rely upon historical/dated information, but must constantly acquire current data to ensure that adequate postage has been applied for shipping purposes.

A need, therefore, exists for system and method which facilitates dimensional rating of a mailpiece/parcel, and, more particularly, to a system and method for accurately and conveniently measuring the length/volume of an article to determine the postage requirements for delivery.

BRIEF DESCRIPTION OF THE DRAWINGS

The accompanying drawings illustrate presently preferred embodiments of the invention and, together with the detailed description given below, serve to explain the principles of the invention. As shown throughout the drawings, like reference numerals designate like or corresponding parts.

SUMMARY OF THE INVENTION

A mailing machine is provided for the creation of mailpieces. The mailing machine includes a print station and a transport system for passing a length of the label material through the print station to receive information on a face surface of the label material. A processor is adapted to store rating information based upon the weight and dimensions of the mailpiece and is operatively coupled to, and controls, the print station and transport system. In a first operating mode, the processor prints rating information on a length of label material, and in a second operating mode, the processor prints postage indicia on the face surface of the label material based upon the rating information for subsequent application to a mailpiece. In the second operating mode, the postage indicia may optionally be printed on the label material or directly on the face surface of the mailpiece envelope.

DETAILED DESCRIPTION OF THE INVENTION

A system and method is provided for the creation of "mailpieces" which, in the context used herein means an article prepared for distribution by a delivery service/agent. More specifically, the system and method facilitates determination of the postage indicia, i.e., the value thereof, required for delivery of a mailpiece by providing an operator with dimensional rating information necessary to determine the value of the postage indicia. In context used herein, "mailpieces" include self-mailers, folded/tabbed mail, parcels, postcards, bound and/or wrapped magazines, newsletters, newspapers, etc.

While the invention is described in the context of a simple desktop mailing machine, it should be appreciated that any mail creation device which includes a means for printing and metering postage indicia may be employed. A mailing machine merely provides an illustrative example of one embodiment of the invention, and should not be considered limiting when interpreting the meaning and/or scope of the appended claims.

Figure 1:
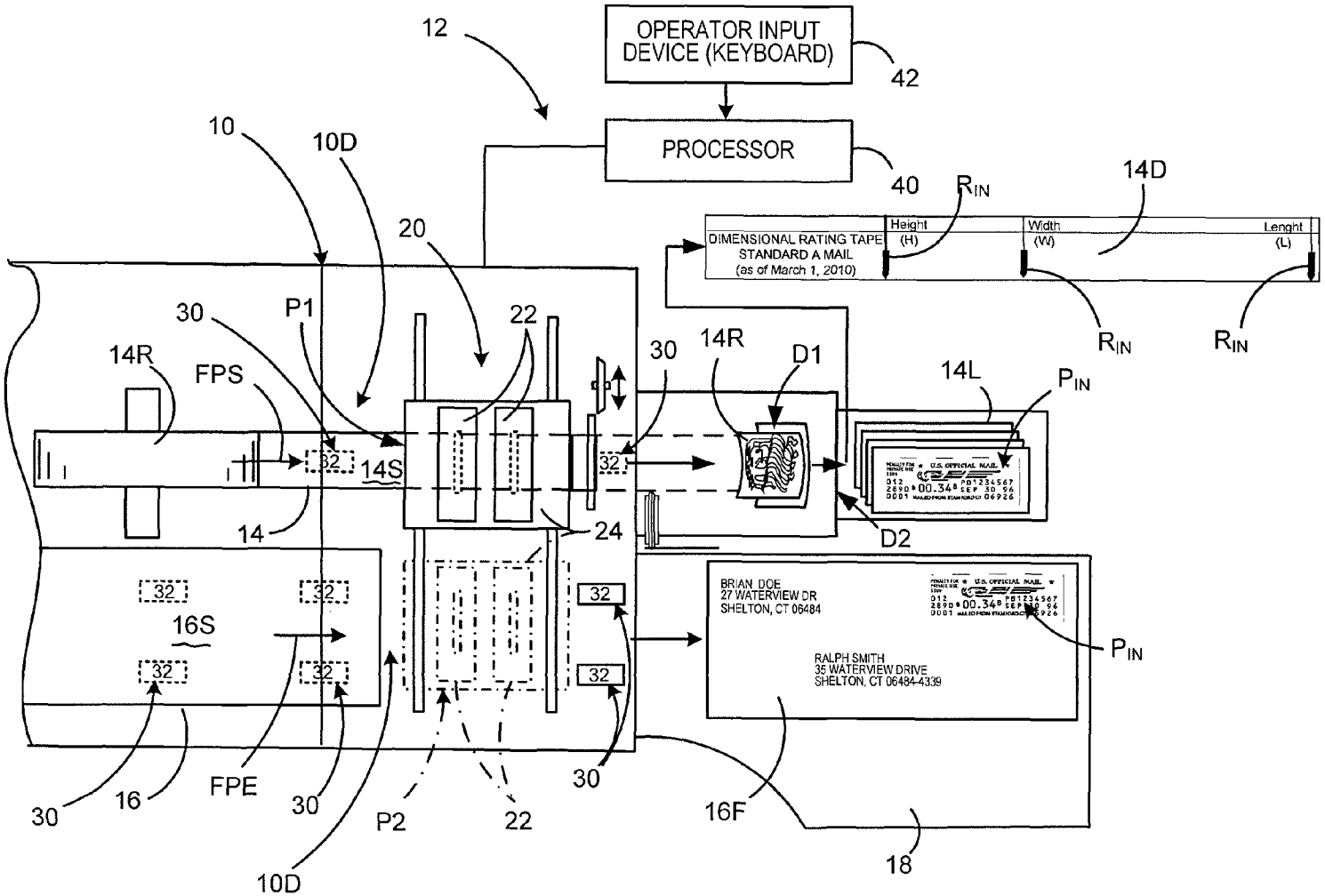
FIG. 1 depicts a top view of a mailing machine according to the present invention which is adapted to (i) produce a dimensional rating tape having dimensional rating information printed thereon, and (ii) print postage indicia on the face surface of a label material based upon the dimensional rating information.

FIG. 1 depicts a schematic, broken-away top view of a mailing machine 10 according to the teachings of the present invention. The mailing machine 10 includes a system 12 operative to, in a first operating mode, produce a dimensional rating tape 14D based upon dimensional rating information and, in a second operating mode, producing one of (i) a postage indicia/franking label 14R, or 14L (hereinafter referred to simply as a "postage label"), i.e., an adhesive-backed label for subsequent application to a mailpiece envelope, and (ii) a franked mailpiece envelope 16F, i.e., an envelope having postage indicia printed thereof, based upon the dimensional rating information. With respect to the second operating mode, the mailing machine 10 is adapted to optionally print postage indicia on the face surface 14S of a length of the label material 14, or directly on the face surface 16S of a mailpiece envelope 16. The various operating modes and printing options are more fully discussed hereinafter.

The system 12 of the present invention includes a print station 20 for receiving a supply of label material 14 and/or mailpiece envelopes 16, a transport system 30 for passing the label material 14 and/or a mailpiece envelope 16 across or through the print station 20, i.e., such that the print station 20 may print information on the label material 14 and/or the mailpiece envelope 16, and a processor 40 for controlling the print station 20 and transport system 30 in the first and second operating modes.

The print station 20 is conventional and includes a plurality of print heads/nozzles 22 disposed a predetermined height or dimensional distance away from the face surface for receiving ink. The mailing machine 10 of the present invention includes an option to print on: (i) a supply of label material 14R or (ii) directly on the face 16F of the mailpiece envelope 16. This option may be input by an operator, i.e., via a keyboard or touch-screen input device 42, and is achieved by mounting one or more of the print heads/nozzles 22 on a moveable carriage 24 which extend orthogonally across the feed path FPS of the roll//spool 14R of the label material 14, and across the feed path FPE the mailpiece envelope 16. More specifically, the processor 40 is operatively coupled to an actuator (not shown) of the print station 20 to reposition the print heads/nozzles 22 over or along one of the feed paths FPS, FPE depending upon the selected option. In a first position P1 (shown in solid lines), the print heads/nozzles 22 are disposed across the feed path FPS of the roll/spool supply 14R of the label material 14 to print on a face surface 14S thereof. In a second position P2 (shown in phantom lines), the print heads/nozzles 22 are disposed across the feed path FPE of the envelope 16 to print information and postage indicia $P_{IN}$ directly on the face 16S of the mailpiece envelope 16.

The transport system 30 comprises a plurality of rollers for engaging an underside surface of the label material 14 and mailpiece envelope to pass the label material 14 and/or envelope 16 across or through the print station 12, i.e., along the feed paths FPS, FPE, such that information may be printed on the face surfaces 14S, 16S of the respective label material 14 and envelope 16. The rollers 32 of the transport system 30 are controlled by the processor 40 to convey the label material 14 and envelope 16 along a transport deck 10D of the mailing machine 10. With respect to the label material 14, the transport system 30 conveys a length of label material 14 through the print station 20 to a dispensing system 60 which dispenses the label material 14 out of one of several exit orifices D1, D2. Strips of dimensional rating tape 14D (discussed in greater detail hereinbelow) may be dispensed through either of the exit orifices D1, D2. Application ready postage indicia labels 14R are dispensed through a first exit orifice D1 which faces upwardly for ease of dispensation. Lined labels 14L, i.e., postage labels having a removable liner or an adhesive backing for subsequent wetting, are dispensed through a second orifice D2 which is disposed aft to allow multiple labels to be printed. i.e., either as a plurality of individual labels 14L or as a strip (not shown) of lined labels.

A processor 40 controls the various operations of the mailing machine 10 including control of the print station 20 and transport system 30, i.e., conveyance of label material 14 and/or mailpiece envelopes 16 through the print station 20 by the transport system 30. Furthermore, the processor 40 stores current rating information for determining the appropriate postage to be applied by the mailing machine 10, i.e., the internal postage meter. In the context used herein "rating information" means any rating data available to, and/or stored within, the processor for determining the value of the postage indicia applied by the mailing machine 10, i.e., value of the postage indicia printed by the print station 20. The current rating information may be input via an operator through the input device 42, or be received electronically over an electronic communication network, e.g., an Internet connection. With respect to the latter, the processor 40 may receive rating information instantaneously, or periodically, to ensure that the postage applied is current and accurate.

Before describing the operation of the system and method for determining the value of postage indicia required for delivery of a mailpiece, it may be useful to describe the manner in which certain Postal Services prescribe dimensional ratings for delivery of mailpieces. Currently, the US Postal Service provides for four (4) standard size boxes having prescribed dimensions for its Priority Mail Service. Each dimension may be viewed as a "Break-Point" or a point wherein the cost of delivery will vary, i.e., increase. A first small box has a length dimension of eight and five-eights inches (8.625"), a width dimension of five and three-eights inches (5.375"), and a height dimension of one and five-eights inches (1.625"). A second medium box has a length dimension of thirteen and five-eights inches (13.625"), a width dimension of eleven and seven-eights inches (11.875"), and a height dimension of three and three-eights inches (3.375"). A third medium box has a length dimension of eleven inches 911"), a width dimension of eight and one-half inches (8.5"), and a height dimension of five and one half inches (5.5"). And, a fourth large box has a length dimension of twelve inches (12"), a width dimension of twelve inches (12"), and a height dimension of five and one half inches (5.5"). A weight limit generally applies to deliveries abroad.

In the context used herein, the phrase "break point" means a threshold value wherein the incremental cost of delivery changes from one value to another value, i.e., typically a higher value. For example, if the "break point" in length for delivering a package is twelve inches (12.0"), then packages having a length of twelve and one half inches (12.5") would be charged differently than those whose length less than the break point, e.g., eleven and one half inches (11.5"). These thresholds are applicable to any one of the three spatial dimensions, e.g., length, width and height. If a single break-point is exceeded, i.e., the break points associated with length, width and/or height, then the next, or higher range, applies in terms of delivery cost. Hence, if the length and height of a parcel are below the respective break-points, but the break-point associated with the width is exceeded, then the cost associated with the higher value, i.e., the cost associated with the higher range of width applies in terms of delivery cost.

Returning to our discussion of the inventive mailing machine 10, i.e., the processor 40 stores current dimensional rating information relating to the various break-points associate with the dimensions of a mailpiece, i.e., the length, height and width dimensions thereof. If an operator is unsure as to whether a particular mailpiece is dimensionally within the respective breakpoints of a particular class of mailpiece, then the operator may input a command to print a dimensional rating tape 14D associated with the class of mail being delivered.

Figure 2:
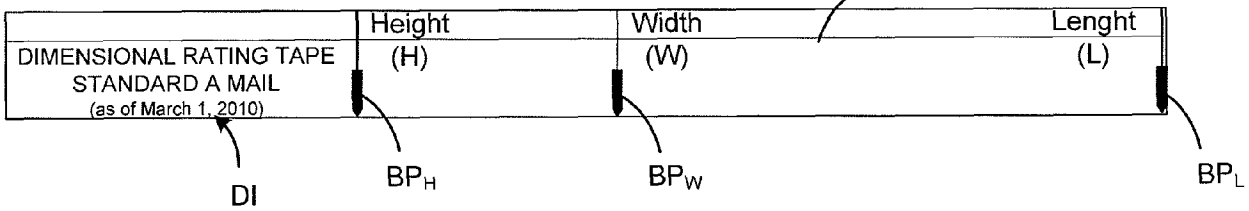
FIG. 2 is a dimensional rating tape produced by the mailing machine of the present invention wherein the dimensional rating tape includes dimensional rating information associated with the height, width and length, respectively, of a Standard A class piece of mail.
Figure 3:
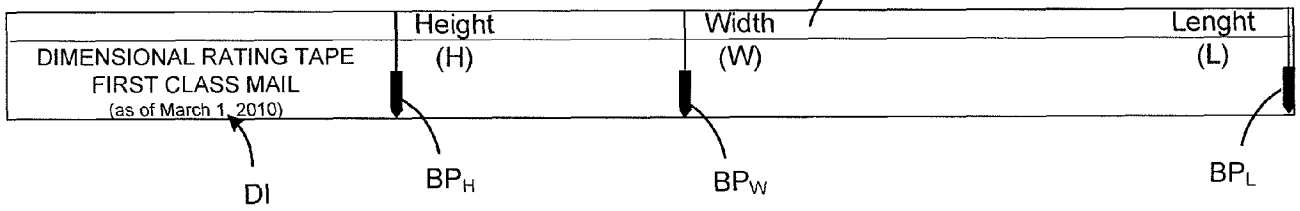
FIG. 3 is a dimensional rating tape produced by the mailing machine of the present invention wherein the dimensional rating tape includes dimensional rating information associated with the height, width and length, respectively, of a First Class piece of mail.
Figure 4:
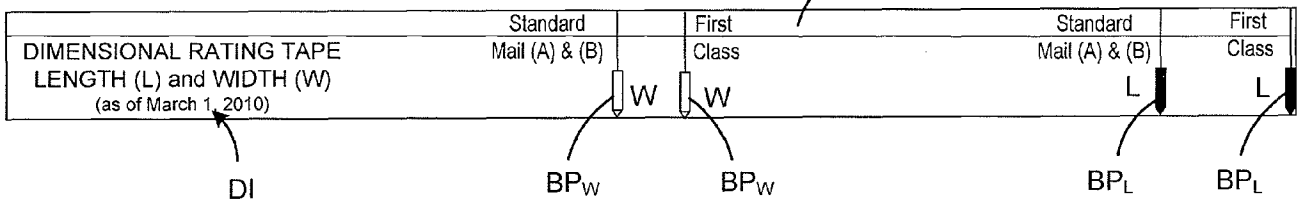
FIG. 4 is a dimensional rating tape produced by the mailing machine of the present invention wherein the dimensional rating tape includes dimensional rating information associated with the width and length, respectively, of Standard A, Standard B and First Class pieces of mail.

FIGS. 2, 3 and 4 depict exemplary dimensional rating tapes 14D produced by the mailing machine 10 of the present invention wherein each of the tapes 14D are associated with various classes of mail. In FIG. 2, a dimensional rating tape $\mathbf{14}D_{SM}$ may be produced by the mailing machine for Standard A class mail. Break points $BP_H$, $BP_W$, $BP_L$ associated with the height, width and length, respectively, of a Standard A class mailpiece are depicted. Inasmuch as these break points are associated with the rating data as of a particular date, it may be desirable to print the current date information DI i.e., the date when the dimensional rating was initially established/issued. In FIG. 3, a dimensional rating tape $\mathbf{14}D_{FC}$ may be produced by the mailing machine for First Class mail. Break points $BP_H$, $BP_W$, $BP_L$ associated with the height, width and length, respectively, of a First Class mailpiece are depicted. In FIG. 4, a dimensional rating tape $\mathbf{14}D_{LW}$ may be produced by the mailing machine for a combination of Standard (A), Standard (B), and First Class mail. Break points $BP_W$ and $BP_L$ associated with the width and length, respectively, of Standard (A), Standard (B), and First Class mailpieces are depicted. While each of the dimensional rating tapes $\mathbf{14}D_{SM}$, $\mathbf{14}D_{FC}$ and $\mathbf{14}D_{LW}$ are associated with either a class of mailpiece, or the break-points associated with the particular dimensions (i.e., the width and length) of classes of mail (i.e., Standard and First Class Mail), it will be appreciated that any combination of mail, or dimensional ratings therefor, may be printed to produce a dimensional rating tape 14D.

Once produced, the operator uses one or more of these dimensional rating tapes 14D for comparatively determining the break points associated with a particular mailpiece. More specifically, the operator places the dimensional rating tape against the mailpiece to determine whether the mailpiece exceeds any one of the break-points printed on the tape 14D. Based upon the comparative analysis performed by the operator, the operator may then input this information into the mailing machine, i.e., via the input device 42, such that the processor may calculate the value of postage required to deliver the mailpiece. This information may, of course, be combined and compared with, rating information associated with the weight to determine the proper value of postage. That is, since many mailing machines are equipped with a weighing apparatus to determine the weight of a mailpiece, weight data may also be used to determine the delivery cost of the mailpiece. For example, if the rating data is dominated by the dimensions of a mailpiece, then the dimensional rating information will determine the cost of delivering the mailpiece. On the other hand, if the rating data is dominated by the weight of the mailpiece, then the weight rating will determine the value of postage required for delivery.

Having determined the proper rating for a particular mailpiece, i.e., based upon the weight and/or dimensional rating information, the mailing machine prints postage indicia on one of (i) the label material for subsequent application to the mailpiece envelope or (ii) directly on the face surface of the mailpiece envelope.

While the dimensional rating tape 14D of the present invention has been described in terms of measuring one of either a length, width and/or height of a particular mailpiece, it should be appreciated that the tape 14D may also be used to measure other relevant dimensions of a mailpiece. For example, the tape 14D may be wrapped around the periphery of a mailpiece or parcel to determine the girth or volume of the mailpiece. Furthermore, while the dimensional rating tape 14D is shown as having printing break-points associated with multiple dimensions, i.e., the length, width and height, the dimensional rating tape 14D may be produced to measure a single break-point, e.g., the length, inasmuch as an operator may know that the other break-points, e.g., width and height are well within the limits of a related break-point.

In summary, the mailing machine of the present invention provides a convenient and readily available system and method for dimensional rating of mailpieces. The mailing machine facilitates the interchangeable use of a conventional label printing station, i.e., a portion of the mailing machine conventionally dedicated to printing application ready, lined or adhesively-backed labels, as a device for producing a dimensional rating tape. Inasmuch as the processor of the mailing machine typically stores, or may be adapted to instantaneously retrieve (via an Internet or cloud connection), dimensional rating information associated with nearly any class of mail, i.e., both for domestic and foreign postal services, an operator may conveniently request the fabrication of a dimensional rating tape for the class of mailpiece for which postage is being requested and printed. The information may be combined with weight rating information, at least on mailing machines having weight measurement apparatus, to obtain accurate and reliable rating information to produce/print postage indicia on a mailpiece envelope or on a label for subsequent application to a mailpiece.

Although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. A mailing machine for creating a mailpiece, comprising:

a print station;

a transport system for passing a length of a label material through the print station such that information is printed on a surface of the label material; and a processor adapted to store rating information related to the weight and dimensions of a mailpiece, and operatively coupled to, and controlling, the print station and transport system to:

in a first operating mode, print rating indicia on the face surface of the label material; wherein the rating indicia comprise a plurality of break-points, each break-point indicating a threshold for a dimension at which a delivery cost changes; and wherein the length of the label material is configured for comparatively determining the postage of the mailpiece; and in a second operating mode, print postage indicia on the face surface of the label material based upon the rating information, for subsequent application to the mailpiece.

2. The mailing machine according to claim 1 wherein the rating information includes at least one rating indicia indicative of a length of the mailpiece.

3. The mailing machine according to claim 2 further comprising a cutting apparatus adapted to cut the label material, and wherein the processor controls the transport system and cutting apparatus to dispense and cut a length of label material based upon a length associated with the at least one rating indicia indicative of the length of the mailpiece.

4. The mailing machine according to claim 1 wherein the processor is adapted to store rating information associated with postal services associated with various territories.

5. The mailing machine according to claim 1 wherein the plurality of break-points are printed for at least two dimensions of the mailpiece.

6. The mailing machine according to claim 5 wherein the plurality of break-points are distinguished from each other by varying color of the plurality of break-points.

7. The mailing machine according to claim 1 wherein the mailing machine is adapted to, in the second operating mode, cause the print station to print postage indicia on a face surface of the mailpiece based upon the rating information.

8. A system is provided to facilitate the dimensional rating of a mailpiece, comprising:

a print station adapted to print on a length of a label material;

a transport system for passing the label material through the print station to print information on a surface of the label material; and a processor adapted to store rating information based upon the weight and dimensions of a mailpiece, and operatively coupled to, and controlling, the print station and transport system to:

in a first operating mode, print rating indicia on the label material to produce a dimensional rating tape; wherein the rating indicia comprise a plurality of break-points, each break-point indicating a threshold for a dimension at which a delivery cost changes; and wherein the length of the dimensional rating tape is configured for comparatively determining the postage of the mailpiece; and in a second operating mode, print postage indicia on the face surface of one of: (1) the label material based upon the rating information for subsequent application to the mailpiece and (2) the mailpiece based upon the rating information.

9. The system according to claim 8 wherein the rating information includes at least one rating indicia indicative of a length of the mailpiece.

10. The system according to claim 9 further comprising a cutting apparatus adapted to cut the label material, and wherein the processor controls the transport system and cutting apparatus to dispense and cut the dimensional rating tape based upon a length associated with the at least one rating indicia indicative of the length of the mailpiece.

11. The system according to claim 8 wherein the processor is adapted to store rating information associated with postal services associated with various delivery territories.

12. The system according to claim 8 wherein the plurality of break-points are printed for at least two dimensions of the mailpiece.

13. The system according to claim 12 wherein the plurality of break-points are distinguished from each other by varying color of the plurality of break-points.

14. The system according to claim 13 wherein the system is configured to receive comparison data regarding whether a length of the mailpiece exceeds a break-point of the plurality of break-points printed on the length of the dimensional rating tape.

* * * * *